US008762031B2

(12) United States Patent
Wada

(10) Patent No.: US 8,762,031 B2
(45) Date of Patent: Jun. 24, 2014

(54) INTERNAL COMBUSTION ENGINE CONTROL APPARATUS

(75) Inventor: Shuichi Wada, Kobe (JP)

(73) Assignee: Mitsubishi Electric Corporation, Tokyo (JP)

( * ) Notice: Subject to any disclaimer, the term of this patent is extended or adjusted under 35 U.S.C. 154(b) by 362 days.

(21) Appl. No.: 13/222,835

(22) Filed: Aug. 31, 2011

(65) Prior Publication Data

US 2012/0271530 A1 Oct. 25, 2012

(30) Foreign Application Priority Data

Apr. 19, 2011 (JP) ..... 2011-092984

(51) Int. Cl.

| | |
|---|---|
| ***F02M 7/00*** | (2006.01) |
| ***F02D 31/00*** | (2006.01) |
| ***F02D 33/00*** | (2006.01) |
| *F02M 7/04* | (2006.01) |

(52) U.S. Cl.

CPC ..... *F02D 31/007* (2013.01); *F02D 33/003* (2013.01)

USPC ..... 701/104; 123/436

(58) Field of Classification Search

USPC ..... 701/102, 103, 104, 67, 68; 123/674, 123/679, 681, 494, 436; 477/8, 181

See application file for complete search history.

(56) References Cited

U.S. PATENT DOCUMENTS 4,807,132 A * 2/1989 Arai et al. ..... 701/104

FOREIGN PATENT DOCUMENTS

| | | | |
|---|---|---|---|
| JP | 2000-025492 | A | 1/2000 |
| JP | 2002-266895 | A | 9/2002 |
| JP | 2008-528902 | A | 7/2008 |
| JP | 2010-181014 | A | 8/2010 |

OTHER PUBLICATIONS

Japanese Office Action dated Jul. 3, 2012.

* cited by examiner

*Primary Examiner* — Mahmoud Gimie
(74) *Attorney, Agent, or Firm* — Sughrue Mion, PLLC

(57) ABSTRACT

There is obtained an internal combustion engine control apparatus that can accurately determine the state of coupling between an internal combustion engine and a driving device so as to appropriately control the internal combustion engine. An internal combustion engine control apparatus according to the present invention includes a reference value learning function that learns a real calculation value, as the reference learning value for a transmission gear, when there are satisfied a first condition that the vehicle speed detected by a vehicle speed sensor, the real rotation speed detected by a rotation sensor, and the throttle opening degree detected by a throttle opening degree sensor are in predetermined ranges and a second condition that the real calculation value indicating the ratio of the vehicle speed detected by the vehicle speed sensor to the real rotation speed detected by the rotation sensor is in a predetermined state.

4 Claims, 5 Drawing Sheets

INTERNAL COMBUSTION ENGINE CONTROL APPARATUS

BACKGROUND OF THE INVENTION

1. Field of the Invention

The present invention relates to an internal combustion engine control apparatus that controls an internal combustion engine mounted in a vehicle, and more particularly to an internal combustion engine control apparatus that controls an internal combustion engine, based on the coupling state of the clutch of a vehicle such as a motorcycle, a buggy vehicle, or a snowmobile.

2. Description of the Related Art

In general, an internal combustion engine mounted in a vehicle is coupled, through a clutch, with the driving device of the vehicle, such as a tire; depending on the coupling state of the clutch, i.e., the state of coupling between the internal combustion engine and the driving device of the vehicle, the rotation of the internal combustion engine may become unstable. For example, in a state (referred to also as a state where a clutch lever is being released) where the internal combustion engine and the driving device are completely coupled with each other, because the internal combustion engine is also driven by the rotating tires through the clutch, the rotation of the internal combustion engine itself is stable; however, when the foregoing state is followed by a state (referred to also as a state where a clutch lever is being pulled) where the internal combustion engine and the driving device are not coupled with each other, because the internal combustion engine is suddenly released from the drive by the tires, the rotation of the internal combustion engine may become unstable.

In general, in the control apparatus for an internal combustion engine provided with an electronic-control fuel injection device, a control unit calculates a fuel supply amount in accordance with the rotation speed of the internal combustion engine or the state of the load, and drives an injector, which is a fuel injection valve, through a control signal based on the calculation so as to control the amount of fuel to be supplied to the internal combustion engine; however, as described above, there may be a case where depending on the coupling state of the clutch, the rotation of an internal combustion engine becomes unstable; thus, to date, there has been detected the coupling state of the clutch, based on the output of a clutch switch that opens or closes in conjunction with the clutch lever (for example, refer to Patent Document 1), or there has been determined the coupling state of the clutch, based on the rotation speed of the internal combustion engine and the traveling speed of the vehicle (for example, refer to Patent Document 2), and there has been adjusted the amount of fuel injection by the electronic fuel injection, based on the detected or the determined coupling state of the clutch, so that the rotation of the internal combustion engine is stabilized.

PRIOR ART REFERENCE

Patent Document

[Patent Document 1] Japanese Patent Application Laid-Open No. 2000-25492

[Patent Document 2] Japanese Patent Application Laid-Open No. 2002-266895

In the foregoing case where based on the output from the clutch switch, the coupling state of the clutch is detected, in many cases, the mounting position of the clutch-switch mechanical contact varies depending on a vehicle; therefore, in some vehicles, the coupling state of the clutch may not correctly be detected.

On the other hand, in the case where the coupling state of a clutch is determined by use of the rotation speed of an internal combustion engine and the traveling speed of a vehicle, for example, in the case of a motorcycle, after purchasing the motorcycle, the user may replace a sprocket or a tire, or may change the tire diameter; therefore, the relationship between the rotation speed of an internal combustion engine and the traveling speed of a vehicle at a time when the vehicle is produced differs from that at a time after the foregoing change has been implemented by the user; thus, it becomes difficult to correctly obtain determination data and the like on the coupling state of the clutch at a time when the vehicle has produced, whereby the coupling state of the clutch cannot correctly be determined and hence the fuel supply amount and the like cannot appropriately be changed or cannot appropriately be increased or decreased; therefore, an engine stall or the like may be caused.

In the case where a vehicle starts moving, the method of operating the throttle or the clutch lever differs depending on a user; in practice, before the traveling speed of the vehicle is detected, the user has released the clutch lever; thus, the determination on the coupling state of the clutch may not be performed. Or, unless the determination on the coupling state of a clutch is performed for each gear, the determination may not correctly be performed. As a result, there occurs a delay in the timing of determination on the coupling state of the clutch, in the correction of the fuel supply amount, or in the correction of the air-intake amount, whereby the internal combustion engine may malfunction.

SUMMARY OF THE INVENTION

The present invention has been implemented in order to solve the foregoing problems in a conventional internal combustion engine control apparatus; the objective thereof is to obtain an internal combustion engine control apparatus that can accurately determine the coupling state of a clutch, i.e., the state of coupling between the internal combustion engine and the driving device so as to appropriately control the internal combustion engine.

An internal combustion engine control apparatus according to the present invention includes a clutch that controls coupling between an internal combustion engine mounted in a vehicle and a driving device of the vehicle; a clutch lever that operates the clutch; a vehicle speed sensor that detects a speed of the vehicle; a gear detection device that detects a transmission gear transmitting an output of the internal combustion engine to the driving device; a rotation sensor that detects a real rotation speed of the internal combustion engine; a throttle opening degree sensor that detects an opening degree of a throttle valve for controlling the air-intake amount of the internal combustion engine; an electronic-control fuel injection device that controls the fuel injection amount and the air-intake amount of the internal combustion engine, based on the operation state of at least one of the vehicle and the internal combustion engine; and a clutch state detection unit that determines the state of coupling, through the clutch, between the internal combustion engine and the driving device, based on information on the real rotation speed of the internal combustion engine detected by the rotation sensor and the speed of the vehicle detected by the vehicle speed sensor. In the internal combustion engine control apparatus, at least one of the fuel injection amount and the air-intake amount is corrected in accordance with the state of coupling detected by the clutch state detection unit, and the internal combustion engine control apparatus is characterized by including a reference value learning function that learns a real calculation value, as a reference learning value for the transmission gear, when there are satisfied a first condition that a vehicle speed detected by the vehicle speed sensor, a real rotation speed detected by the rotation sensor, and a throttle opening degree detected by the throttle opening degree sensor are in predetermined ranges and a second condition that the real calculation value indicating the ratio of the vehicle speed detected by the vehicle speed sensor to the real rotation speed detected by the rotation sensor is in a predetermined state.

An internal combustion engine control apparatus according to the present invention includes a reference value learning function that learns a real calculation value, as the reference learning value for a transmission gear, when there are satisfied a first condition that the vehicle speed detected by a vehicle speed sensor, the real rotation speed of the internal combustion engine detected by a rotation sensor, and the throttle opening degree detected by a throttle opening degree sensor are in predetermined ranges and a second condition that the real calculation value indicating the ratio of the vehicle speed detected by the vehicle speed sensor to the real rotation speed detected by the rotation sensor is in a predetermined state; therefore, there can be obtained an internal combustion engine control apparatus that can accurately determine the coupling state of a clutch, i.e., the state of coupling between the internal combustion engine and the driving device so as to appropriately control the internal combustion engine.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
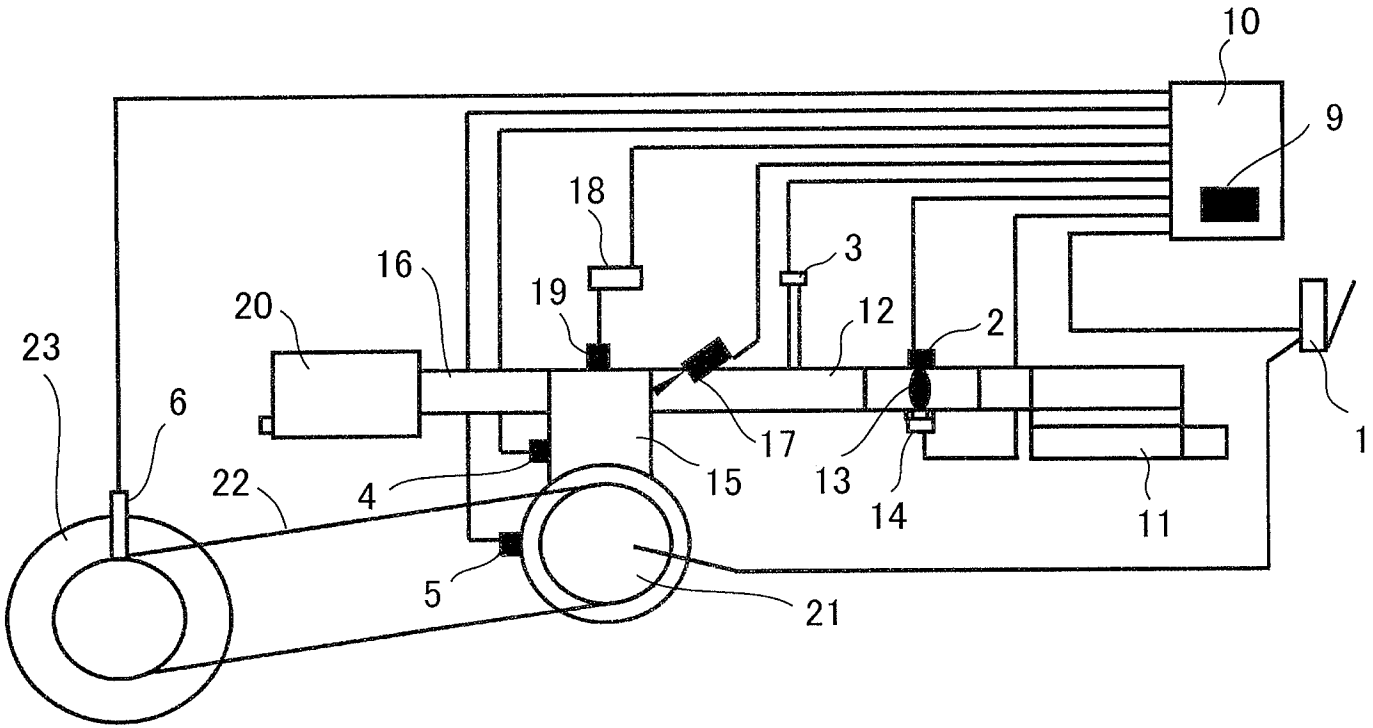
FIG. 1 is a configuration diagram illustrating the overall configuration of an internal combustion engine control apparatus according to Embodiment 1 of the present invention.

Hereinafter, an internal combustion engine control apparatus according to Embodiment 1 of the present invention will be explained with reference to the accompanying drawings. FIG. 1 is a configuration diagram illustrating the overall configuration of an internal combustion engine control apparatus according to Embodiment 1 of the present invention. FIG. 1 illustrates a case where an internal combustion engine control apparatus is applied to a motorcycle. In FIG. 1, an internal combustion engine 15 is provided with a cylinder (unillustrated) and a piston (unillustrated) that is slidably inserted into the cylinder. On the cylinder head of the internal combustion engine 15, there are provided an ignition coil 18 and an ignition plug 19 to which a high voltage is applied by the ignition coil 18 so that a spark discharge is produced inside the cylinder. Moreover, the cylinder of the internal combustion engine 15 is connected with an air-intake path 12 by way of an intake valve (unillustrated) and an exhaust path 16 by way of an exhaust valve (unillustrated).

An air cleaner 11 is provided at the upstream side of the air-intake path 12; a fuel-air mixture of air supplied through the air cleaner 11 into the air-intake path 12 and a fuel injected by a fuel injection module 17 is taken in by the cylinder by way of the intake valve. The pressure of intake air in the air-intake path 12 is detected by an intake pressure sensor 3 provided in the air-intake path 12.

A throttle valve 13 for controlling the amount of air to be taken in is provided at the downstream side, in the air-intake path 12, of the air cleaner 11; the opening degree of the throttle valve 13 is detected by a throttle opening degree sensor 2. In addition, in the air-intake path 12, there is provided a bypass air amount control valve 14 that adjusts the bypass air amount in a bypass air path that bypasses the throttle valve 13. Exhaust gas exhausted, through the exhaust valve, from the cylinder of the internal combustion engine 15 into the exhaust path is exhausted into the air through an exhaust muffler 20. In the exhaust muffler 20, there is provided an exhaust gas purification catalyst for purifying exhaust gas by removing NOx, HC, and CO. An internal combustion engine temperature sensor 14 that is grounded to the wall face of the internal combustion engine 15 measures the temperature of water that passes inside the wall face of the internal combustion engine 15. A crank angle sensor 5 measures the crank angle of the internal combustion engine 15, i.e., the crank position. A vehicle speed sensor 6 detects the vehicle speed, based on the rotation speed of a tire 23, which is a driving device of the vehicle.

A clutch 21 is provided with a first clutch plate that is coupled with the output shaft of the internal combustion engine and is formed in such a way as to be movable in the axis direction; and a second clutch plate that is provided in such a way as to face the first clutch plate in the axis direction and that is coupled with or departs from the first clutch plate when the first clutch plate moves in the axis direction. A clutch lever 1, which is operated by a driver in a pulling manner or in a releasing manner upon a gear change by means of a transmission (unillustrated), is coupled with the first clutch plate of the clutch 21 by way of a wire or the like; the degree of coupling between the first clutch plate and the second clutch plate is adjusted by, through the wire, moving the first clutch plate of the clutch 21 in the axis direction thereof through the driver's pulling operation or releasing operation.

The output shaft, of the clutch 21, coupled with the second clutch plate is coupled with the tire 23, which is a driving device of a vehicle, by way of a driving chain 22. Accordingly, the degree of coupling between the internal combustion engine 15 and the tire 23 is controlled in accordance with the coupling degree of the clutch 21.

A control unit 10 includes a CPU, a ROM, a RAM, an I/O interface (none of them is illustrated), a nonvolatile memory 9, and the like; to the control unit 10, there are inputted the respective detection values from the throttle opening degree sensor 2, the intake pressure sensor 3, the internal combustion engine temperature sensor 4, the crank angle sensor 5, and the vehicle speed sensor 6 and the coupling degree detection value, of the clutch 21, based on the operation state of the clutch lever 1; the control unit 10 performs various calculations, based on the inputted detection values; then, the control unit transmits drive signals based on the calculation to the ignition coil 18, the fuel injection module 17, and the bypass air amount control valve 14 so as to drive these devices.

The nonvolatile memory 9 stores information, required for calculation and the like by the control unit 10, and respective reference learning values, described later, for the gears of the transmission. The nonvolatile memory 9 continues to keep the memory even when the power source is switched off; when the vehicle travels next time, there can be utilized the stored respective reference learning values for the gears.

Figure 2A:
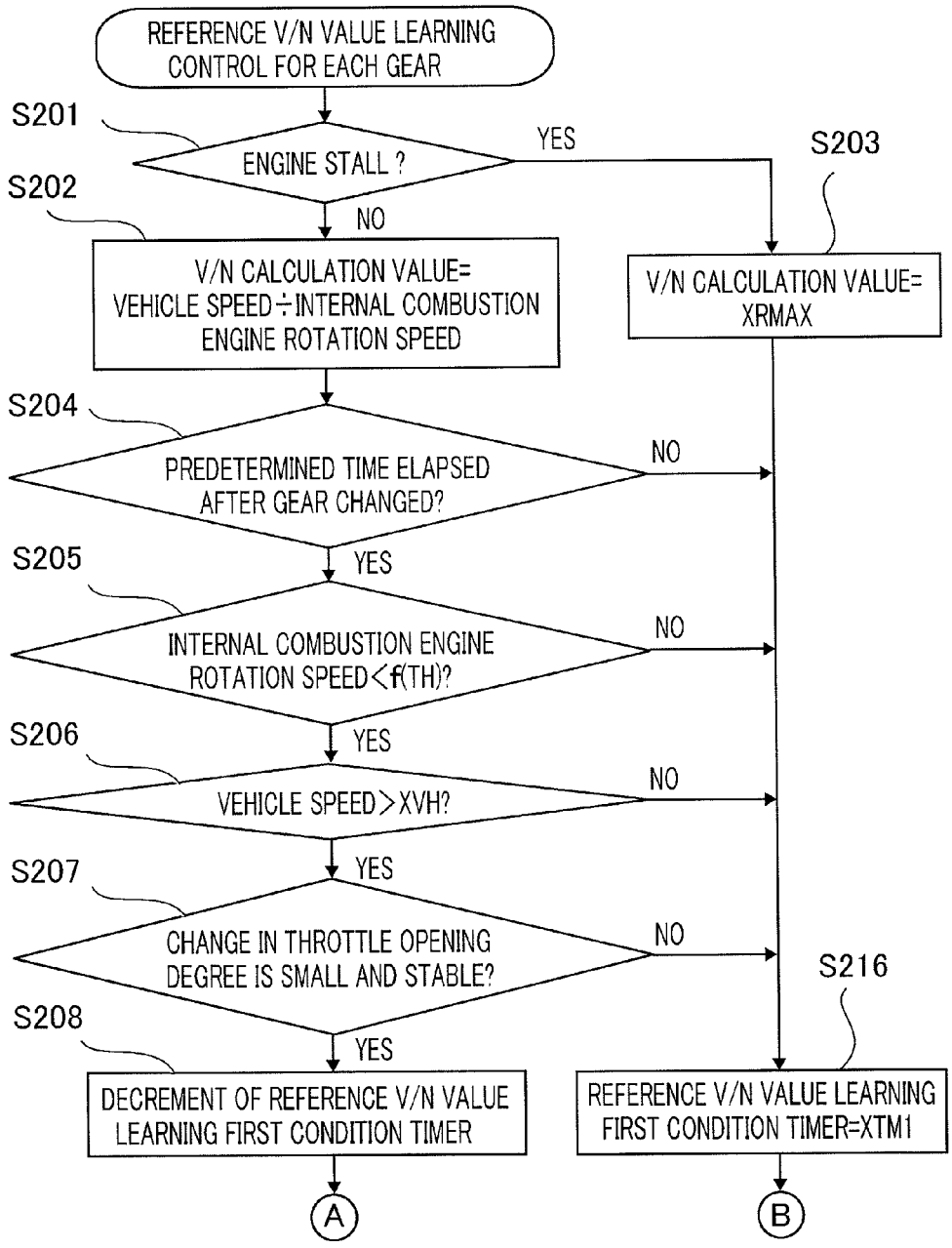
FIGS. 2A and 2B configure a flowchart for explaining the operation of an internal combustion engine control apparatus according to Embodiment 1 of the present invention.
Figure 2B:
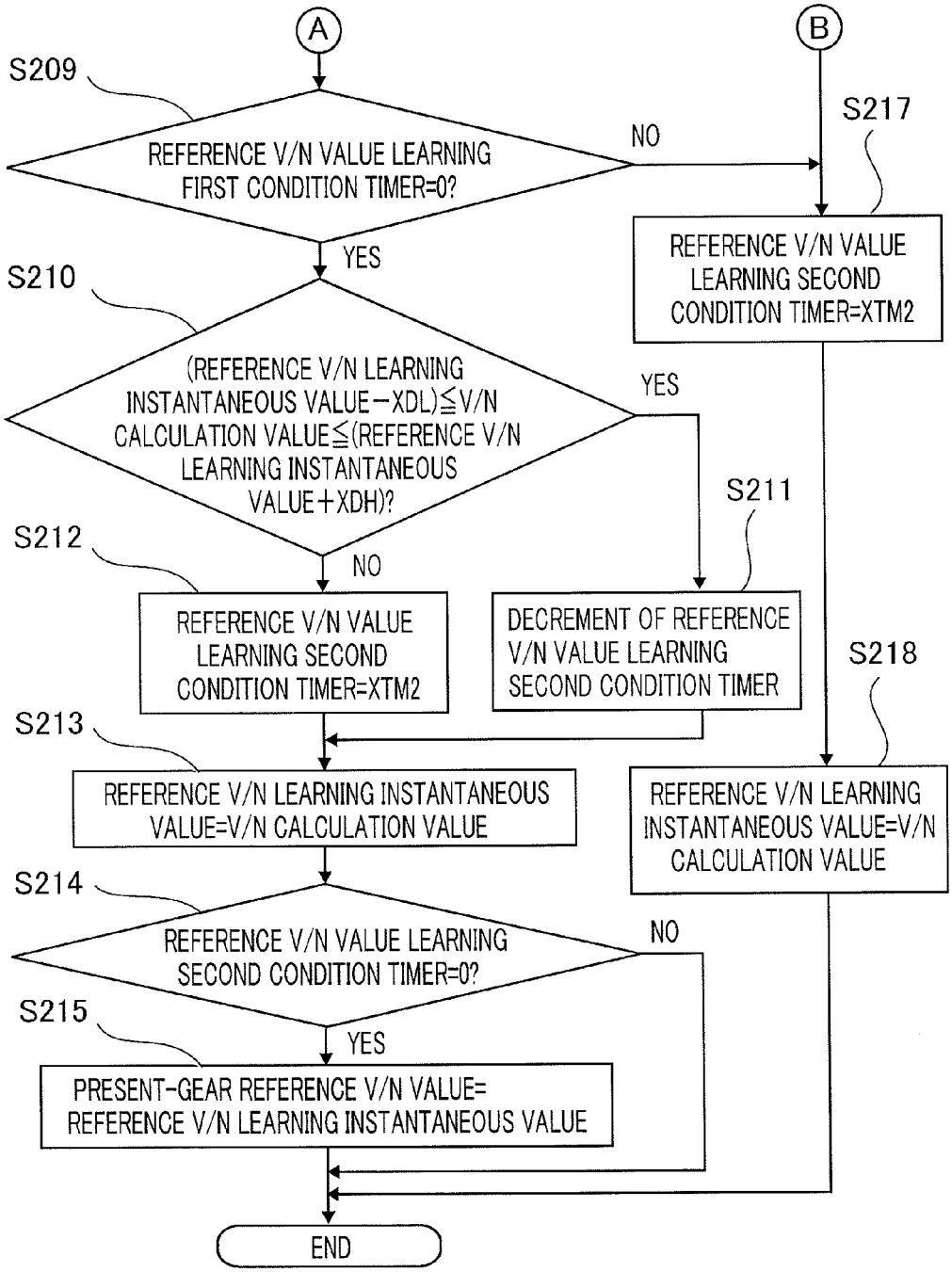

Next, there will be explained the operation of the internal combustion engine control apparatus, according to Embodiment 1 of the present invention, that is configured as described above. FIGS. 2A and 2B configure a flowchart for explaining the operation of the internal combustion engine control apparatus according to Embodiment 1 of the present invention. The flowchart represented in FIGS. 2A and 2B explains a method of learning the reference value (referred to as a reference V/N value, hereinafter) for the ratio (referred to "V/N", hereinafter), of the vehicle speed for each gear of the transmission to the internal combustion engine rotation speed N), that is necessary to estimate and determine the coupling state of the clutch 21, i.e., the state of coupling between the first clutch plate and the second clutch plate.

In FIG. 2A, at first, in the step S201, it is determined whether or not the internal combustion engine 15 is currently in the engine stall mode; in the case where the internal combustion engine 15 is in the engine stall mode (YES), the step S201 is followed by the step S203, where V/N calculation value is set to XRMAX; after that, the step S203 is followed by the step S216, the step S216 is followed by the step S217, and the step S217 is followed by the step S218; then, the routine represented in FIG. 2B is ended. In the step S216, a reference V/N value learning first condition timer is initialized to be set to an initial value XTM1; in the step S217, a reference V/N value learning second condition timer is initialized to be set to an initial value XTM2; moreover, in the step S218, a reference V/N learning instantaneous value is initialized to be set to an initial value V/N calculation value.

In the case where in the step S201, it is not determined that the internal combustion engine 15 is in the engine stall mode (NO), the step S201 is followed by the step S202, where a calculation (V/N calculation value=vehicle speed÷internal combustion engine rotation speed) is performed by the control unit 10; then, the step S202 is followed by the step S204.

In the step S204, it is determined whether or not a predetermined time has elapsed since the gear of the transmission of the vehicle was set to the present one; in the case where it is determined that a predetermined time has elapsed (YES), the step S204 is followed by the step S205. In contrast, in the case where in the step S204, it is determined that a predetermined time has not elapsed (NO), the step S204 is sequentially followed by the steps S216, S217, and S218, where as described above, there are performed the initialization of the reference V/N value learning first condition timer, the initialization of the reference V/N value learning second condition timer, and the initialization of the reference V/N learning instantaneous value, respectively; then, the routine represented in FIG. 2B is ended.

When the step S204 is followed by the step S205, it is determined whether or not the present internal combustion engine rotation speed N is smaller than a rotation speed determination value f(TH); in the case where it is determined that the present internal combustion engine rotation speed N is smaller than the rotation speed determination value f(TH) (YES), the step S205 is followed by the step S206. In contrast, in the case where in the step S205, it is determined that the present internal combustion engine rotation speed N is the same as or larger than the rotation speed determination value f(TH) (NO), the step S205 is sequentially followed by the steps S216, S217, and S218, where as described above, there are performed the initialization of the reference V/N value learning first condition timer, the initialization of the reference V/N value learning second condition timer, and the initialization of the reference V/N learning instantaneous value, respectively; then, the routine represented in FIG. 2B is ended.

As the rotation speed determination value f(TH), there is utilized an elevated value, in the rotation speed N of the internal combustion engine 15, which is experimentally obtained when the throttle valve 13 is opened under the condition that the internal combustion engine 15 is unloaded, i.e., under the condition that the internal combustion engine 15 and the tire 23, which is a driving device, are not coupled with each other. The present rotation speed is determined by use of the rotation speed determination value f(TH) set in such a way as described above, so that there can be prevented erroneous learning of the reference V/N value at a time when the internal combustion engine 15 and the tire 23, which is a driving device, are not coupled with each other.

When the step S205 is followed by the step S206, it is determined whether or not the vehicle speed V is larger than a vehicle speed determination value XVH; in the case where the vehicle speed V is larger than the vehicle speed determination value XVH (YES), the step S206 is followed by the step S207; in the case where the vehicle speed V is the same as or smaller than the vehicle speed determination value XVH (NO), the step S207 is sequentially followed by the steps S216, S217, and S218, where as described above, there are performed the initialization of the reference V/N value learning first condition timer, the initialization of the reference V/N value learning second condition timer, and the initialization of the reference V/N learning instantaneous value, respectively; then, the routine represented in FIG. 2B is ended.

When the step S206 is followed by the step S207, as the check for the stability level of the throttle valve 13, it is determined whether or not the change in the opening degree of the throttle valve 13 is small and stable; in the case where it is determined that the change in the opening degree of the throttle valve 13 is stable (YES), the step S207 is followed by the step S208, where decrement of the reference V/N value learning first condition timer is performed. In contrast, in the case where in the step S207, it is determined that the change in the opening degree of the throttle valve 13 is not stable (NO), the step S207 is sequentially followed by the steps S216, S217, and S218, where as described above, there are performed the initialization of the reference V/N value learning first condition timer, the initialization of the reference V/N value learning second condition timer, and the initialization of the reference V/N learning instantaneous value, respectively; then, the routine represented in FIG. 2B is ended.

As described above, in the case where in all the determinations in the steps S204, S205, S206, and S207, the propositions are affirmed (YES), the step S207 is followed by the step S208. In the step S208, decrement of the reference V/N value learning first condition timer is performed, and then the step S208 is followed by the step S209.

In the step S209, it is determined whether or not the reference V/N value learning first condition timer is "0"; in the case where the reference V/N value learning first condition timer is "0" (YES), the step S209 is followed by the step S210. in the case where in the step S209, it is determined that the reference V/N value learning first condition timer is not "0" (NO), the step S209 is sequentially followed by the steps S217 and S218, where as described above, there are performed the initialization of the reference V/N value learning second condition timer and the initialization of the reference V/N learning instantaneous value, respectively; then, the routine represented in FIG. 2B is ended.

In the step S210, the present V/N calculation value calculated in the step S202 and the reference V/N learning instantaneous value, which has already been obtained, are compared with each other; then, based on the value of the difference, it is checked whether or not the V/N calculation value is stable. Specifically, when the condition "(reference V/N learning instantaneous value−XDL) V/N calculation value≤(reference V/N learning instantaneous value+XDH)" is established (YES), it is determined that the present V/N calculation value is stable, and then the step S210 is followed by the step S211, where decrement of the reference V/N value learning second condition timer is performed; then, the step S211 is followed by the step S213.

In contrast, in the case where in the step S210, the condition "(reference V/N learning instantaneous value−XDL)≤V/N calculation value (reference V/N learning instantaneous value+XDH)" is not established (NO), it is determined that the V/N calculation value is not stable, and the step 211 is followed by the step S212, where the reference V/N value learning second condition timer is initialized; then, the step S212 is followed by the step S213.

The values of XDL and XDH can arbitrarily be set.

In the step S213, the reference V/N learning instantaneous value is set to the present V/N calculation value, and then the step S213 is followed by the step S214. In the step S214, it is determined whether or not the reference V/N value learning second condition timer is "0"; in the case where the reference V/N value learning second condition timer is "0", it is determined that a correct V/N learning value has been obtained, and the step S214 is followed by the step S215, where the present gear reference V/N value is set to the reference V/N learning instantaneous value; then, the processing routine in FIG. 2B is ended. In the case where the reference V/N value learning second condition timer is not "0", the processing routine in FIG. 2B is immediately ended, and it is continued to seek a correct reference V/N value.

As described above, the internal combustion engine control apparatus according to Embodiment 1 of the present invention has a learning function in which with each gear, there is recognized a state where the internal combustion engine and the driving device are completely coupled with each other, i.e., where the first clutch plate and the second clutch plate of the clutch 21 are completely coupled with each other, and the reference V/N value for each gear is set to the V/N calculation value; therefore, even in the case where the user replaces the sprocket or the tire diameter, the coupling state of the clutch can correctly be estimated; thus, unstable rotation of the internal combustion engine and an engine stall are prevented.

In Embodiment 1 of the present invention, as the present gear reference V/N value, there is utilized the reference V/N learning instantaneous value at a time when the reference V/N value learning second condition timer is "0", i.e., the V/N calculation value calculated in the clutch coupling determination routine at the same timing; however, it may be allowed that when the reference V/N value learning first condition timer is "0" and the stability is confirmed in the step S210, a plurality of V/N calculation values is stored, and then the average value of the plurality of V/N calculation values is utilized as the present gear reference value.

The reference value learning function may further include a monitor function in which a real calculation value that indicates the ratio of the vehicle speed to the real rotation speed is monitored every certain time, and in the case where the throttle opening degree is the same as or larger than a predetermined value and there is satisfied a third condition that the real calculation value indicating the ratio of the vehicle speed to the real rotation speed does not change for a predetermined time, the real calculation value indicating the ratio of the vehicle speed to the real rotation speed is learned as the reference learning value for each gear.

Furthermore, the reference value learning function is provided with an upper-limit rotation speed of the internal combustion engine for each throttle opening degree, and may be configured in such a way that in the case where there is satisfied a fourth condition that the real rotation speed of the internal combustion engine is the same as or smaller than the upper-limit rotation speed, the real calculation value indicating the ratio of the vehicle speed to the real rotation speed is learned as the reference learning value for each transmission gear.

In addition, it may be allowed that the reference value for each gear obtained in Embodiment 1 of the present invention is stored in the nonvolatile memory 9 incorporated in the control unit 10, and then is utilized for the determination on the clutch coupling at a time when the vehicle travels next time.

Embodiment 2

Figure 3A:
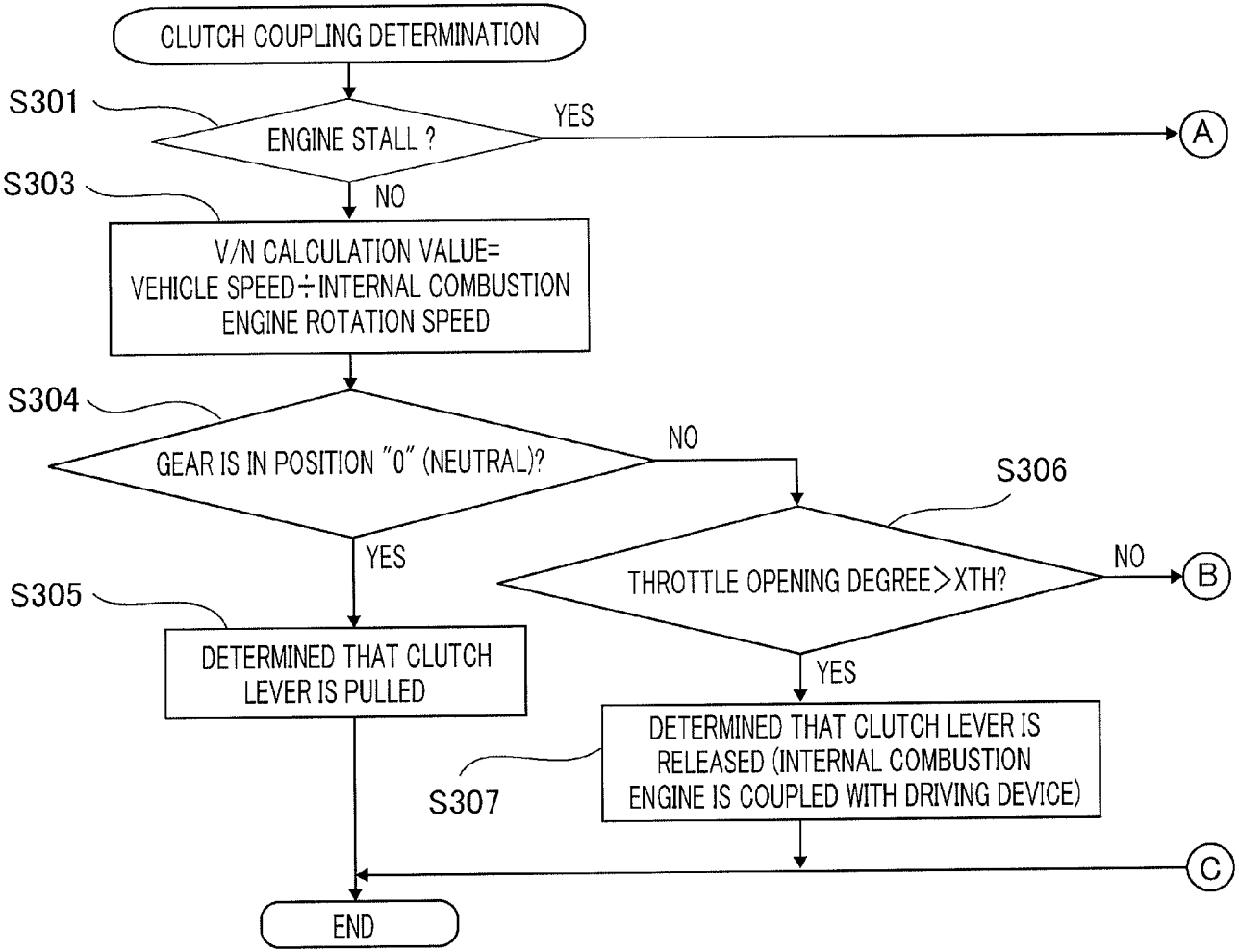
FIGS. 3A and 3B configure a flowchart for explaining the operation of an internal combustion engine control apparatus according to Embodiment 2 of the present invention.
Figure 3B:
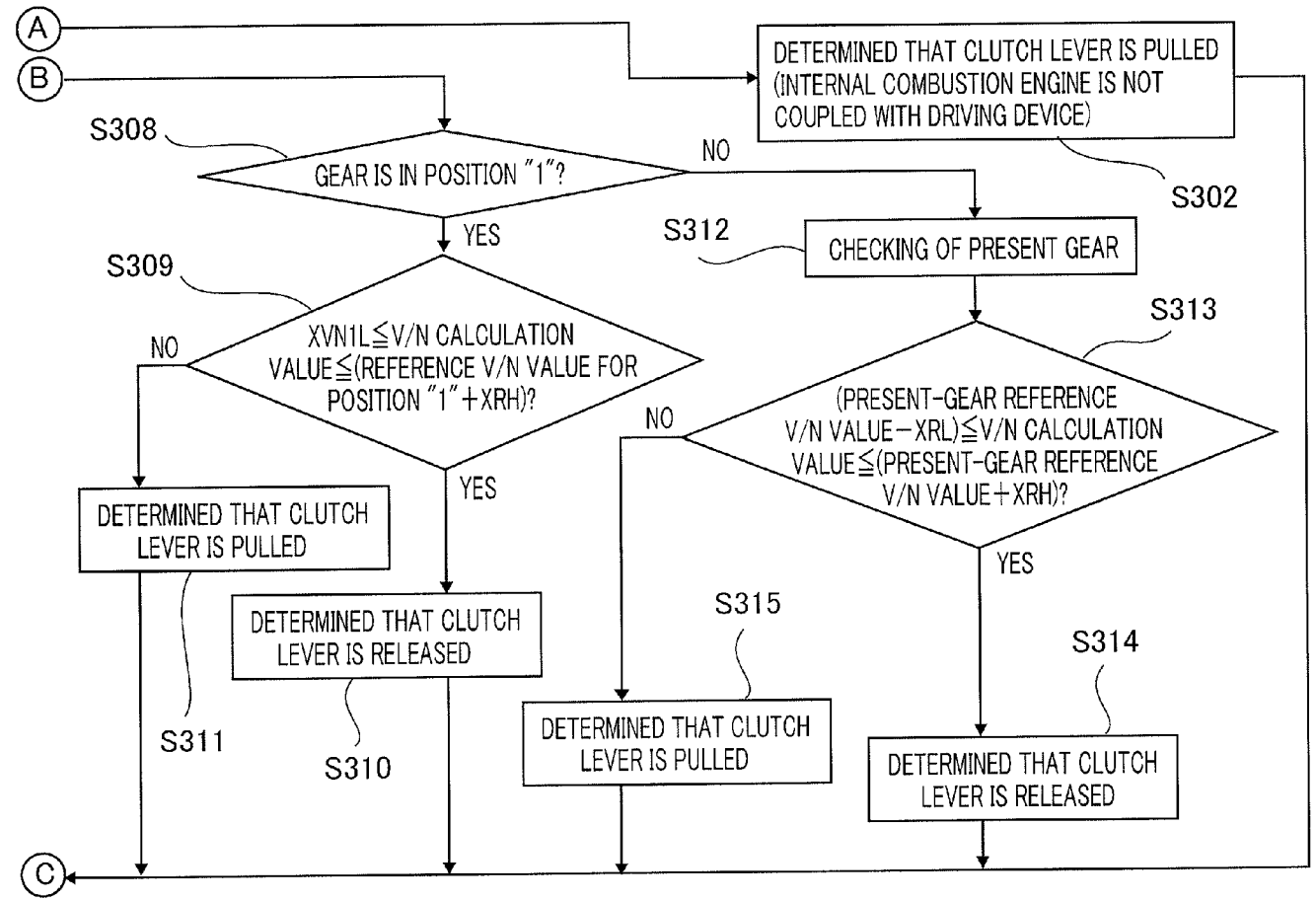

Next, there will be explained an internal combustion engine control apparatus according to Embodiment 2 of the present invention. FIGS. 3A and 3B configure a flowchart for explaining the operation of an internal combustion engine control apparatus according to Embodiment 2 of the present invention. The flowchart in FIGS. 3A and 3B represents a routine in which the coupling state of the clutch 21, i.e., the state of coupling between the first clutch plate and the second clutch plate is estimated and determined, based on the rotation speed of an internal combustion engine and the vehicle speed.

Firstly, in the step S301, it is determined whether or not the internal combustion engine 15 is in the engine stall mode; in the case where the internal combustion engine 15 is in the engine stall mode (YES), the step S301 is followed by the step S302, where it is determined that the clutch lever 1 is being pulled and hence the internal combustion engine 15 and the tire 23, which is a driving device, are not coupled with each other; then, the routine in FIGS. 3A and 3B is ended.

In contrast, in the case where in the step S301, it is determined that the internal combustion engine 15 is not in the engine stall mode (NO), the step S301 is followed by the step S303, where the calculation "V/N calculation value=vehicle speed÷rotation speed of the internal combustion engine" is performed.

After that, there is implemented processing in which based on the obtained V/N calculation value, the coupling state of the clutch 21, i.e., the state of coupling between the internal combustion engine 15 and the tire 23, which is a driving device, is determined. In other words, in the step S304, it is determined whether or not the gear is now in the neutral position, i.e., the "0" position; in the case where it is determined that the gear is now in the neutral position, i.e., the position "0" (Yes), the step S304 is followed by the step 305, where it is determined that the clutch lever is being pulled, i.e., the first clutch plate and the second clutch plate of the clutch 21 are separated from each other and hence the clutch 21 is cut off (released); that is to say, it is determined that the internal combustion engine 15 and the tire 23, which is a driving device, are not coupled with each other; then, the determination on clutch coupling in FIG. 3A is ended.

In contrast, in the case where it is determined in the step S304 that the gear is not in the neutral position, i.e., not the position "0" (NO), the step S304 is followed by the step S306, where it is determined whether or not the present opening degree of the throttle valve 13 is larger than a predetermined value XTH; in the case where it is determined that the present opening degree of the throttle valve 13 is larger than the predetermined value XTH (YES), the step S306 is followed by the step S307, where it is determined that the clutch lever is being pulled and the internal combustion engine 15 and the tire 23, which is a driving device, are coupled with each other; then, the routine in FIG. 3A is ended.

In contrast, in the case where it is determined in the step S306 that the present opening degree of the throttle valve 13 is not larger than the predetermined value XTH (NO), the step S306 is followed by the step S308, where it is determined whether or not the present gear is the first position; in the case where the present gear is the first position (YES), the step S308 is followed by the step S309. In the step S309, the present V/N calculation value calculated in the step S303 and a first predetermined value or the reference V/N value of the first position gear are compared with each other; then, based on the magnitude relationship therebetween and the value of the difference, the state of clutch coupling is checked. Specifically, it is determined whether or not the present V/N calculation value is the same as or larger than the first predetermined value XVN1L and the same as or smaller than (the reference V/N value of the first position gear+XRH); based on the magnitude relationship therebetween and the value of the difference, the coupling state of the clutch 21 is determined.

In the case where in the step S309, it is determined that the condition "XVN1L≤V/N calculation value≤(reference V/N value of the first position gear+XRH)" is satisfied (YES), the step S309 is followed by the step S310, where it is determined that the clutch lever is being pulled and the internal combustion engine 15 and the tire 23, which is a driving device, are coupled with each other through the clutch 21. In contrast, in the case where in the step S309, it is determined that the condition "XVN1L≤V/N calculation value≤(reference V/N value of the first position gear+XRH)" is not satisfied (NO), the step S309 is followed by the step S311, where it is determined that the clutch lever is being pulled and the clutch 21 is cut off, and hence the internal combustion engine 15 and the tire 23, which is a driving device, are not coupled with each other; then, the routine in FIG. 3B is ended.

Next, the determination on the coupling state of the clutch at a time when the gear is set to a position higher than the first position is performed in the following manner. At first, in the step S312, the present gear of the transmission is ascertained, and then the step S312 is followed by the step S313, where the present V/N calculation value and the reference V/N value of the present gear are compared with each other; based on the value of the difference, the coupling state of the clutch 21 is determined. Specifically, it is determined whether or not the condition "(reference V/N value of the present gear−XRL) V/N calculation value≤(reference V/N value of the present gear+XRH)" is established.

In the case where in the step S313, it is determined that the condition "(reference V/N value of the present gear−XRL) ≤V/N calculation value≤(reference V/N value of the present gear+XRH)" is satisfied (YES), the step S313 is followed by the step S314, where it is determined that the clutch lever is being released, i.e., the internal combustion engine 15 and the tire 23, which is a driving device, are coupled with each other. In contrast, in the case where in the step S313, it is determined that the condition "(reference V/N value of the present gear−XRL)≤V/N calculation value≤(reference V/N value of the present gear+XRH)" is not satisfied (NO), the step S313 is followed by the step S315, where it is determined that the clutch lever is being pulled; then, the routine in FIG. 3B is ended.

The values of XRL and XRH can arbitrarily be set.

As the reference V/N value utilized in each of the steps S309 and S313, the reference learning value that is learned and stored in the internal combustion engine control apparatus according to Embodiment 1 is utilized. That is to say, the reference learning value is stored in the reference value learning function; the reference learning value is a value obtained by learning a real calculation value, as the reference learning value for the transmission gear, when there are satisfied a first condition that a vehicle speed detected by the vehicle speed sensor, a real rotation speed detected by the rotation sensor, and a throttle opening degree detected by the throttle opening degree sensor are in predetermined ranges and a second condition that the real calculation value indicating the ratio of the vehicle speed detected by the vehicle speed sensor to the real rotation speed detected by the rotation sensor is in a predetermined state.

As described above, in the internal combustion engine control apparatus according to Embodiment 2 of the present invention, in the case where the transmission is in the neutral position, i.e., in the gear position "0", it is determined that the clutch lever is always being pulled, i.e., the clutch 21 is not coupled, i.e., cut off, and hence the internal combustion engine 15 and the tire 23, which is a driving device, are not coupled with each other; in the case where the transmission is not in the neutral position, i.e., not in the gear position "0", and the opening degree of the throttle 13 is the same as or larger than a predetermined value, it is determined that the clutch lever is being released, i.e., the clutch 21 is coupled, and hence the internal combustion engine 15 and the tire 23, which is a driving device, are coupled with each other; in the case where the opening degree of the throttle 13 is smaller than the predetermined value and the transmission is not in the first gear position, the difference between the V/N calculation value and the reference V/N value is determined; and in the case where the transmission is in the first gear position, determination is performed partially without utilizing the reference V/N value. In other words, the method of determining the coupling state of the clutch is changed in accordance with the transmission gear; therefore, under all conditions, the coupling state of the clutch is determined in a correct manner and at an appropriate timing. As a result, there can be performed switching and increasing or decreasing of the fuel supply amount and the air-intake amount, whereby unstable rotation of the internal combustion engine and an engine stall are prevented.

In addition, in Embodiment 2 of the present invention, as information on the vehicle speed and the rotation speed of the internal combustion engine for determining the coupling state of a clutch, the arithmetic expression "vehicle speed÷internal combustion engine rotation speed" is utilized; however, the arithmetic expression "rotation speed of the internal combustion engine÷vehicle speed" may also be utilized.

Moreover, in Embodiment 2 of the present invention, the reference values for determining the difference value at a time when the coupling state of a clutch is determined are set to the predetermined values XRL and XRH, which are constant values; however, the determination reference voltage may be provided for each gear.

An internal combustion engine control apparatus according to the present invention, described heretofore, is characterized as follows:

(1) There are provided a clutch that controls coupling between an internal combustion engine mounted in a vehicle and a driving device of the vehicle; a clutch lever that operates the clutch; a vehicle speed sensor that detects the speed of the vehicle; a gear detection device that detects a transmission gear transmitting the output of the internal combustion engine to the driving device; a rotation sensor that detects a real rotation speed of the internal combustion engine; a throttle opening degree sensor that detects the opening degree of a throttle valve for controlling the air-intake amount of the internal combustion engine; an electronic-control fuel injection device that controls the fuel injection amount and the air-intake amount of the internal combustion engine, based on the operation state of at least one of the vehicle and the internal combustion engine; and a clutch state detection unit that determines the state of coupling, through the clutch, between the internal combustion engine and the driving device, based on information on the real rotation speed of the internal combustion engine detected by the rotation sensor and the speed of the vehicle detected by the vehicle speed sensor. In the internal combustion engine control apparatus, at least one of the fuel injection amount and the air-intake amount is corrected in accordance with the state of coupling detected by the clutch state detection unit. The internal combustion engine control apparatus is characterized by including a reference value learning function that learns a real calculation value, as a reference learning value for the transmission gear, when there are satisfied a first condition that a vehicle speed detected by the vehicle speed sensor, a real rotation speed detected by the rotation sensor, and a throttle opening degree detected by the throttle opening degree sensor are in predetermined ranges and a second condition that the real calculation value indicating the ratio of the vehicle speed detected by the vehicle speed sensor to the real rotation speed detected by the rotation sensor is in a predetermined state.

(2) The reference value learning function is characterized in that it further includes a monitor function in which a real calculation value indicating the ratio of the vehicle speed to the real rotation speed is monitored every certain time, and in the case where the throttle opening degree is the same as or larger than a predetermined value and there is satisfied a third condition that the real calculation value indicating the ratio of the vehicle speed to the real rotation speed does not change for a predetermined time, it learns, as the reference learning value for each gear, the real calculation value indicating the ratio of the vehicle speed to the real rotation speed.

(3) The reference value learning function is characterized in that it is provided with an upper-limit rotation speed of the internal combustion engine for each throttle opening degree, and in the case where there is satisfied a fourth condition that the real rotation speed of the internal combustion engine is the same as or smaller than the upper-limit rotation speed, it learns, as the reference learning value for each transmission gear, the real calculation value indicating the ratio of the vehicle speed to the real rotation speed.

(4) The internal combustion engine control apparatus is characterized in that there is provided a nonvolatile memory, the contents stored in which are not deleted even when the power source is off, and the reference value learning function stores the reference learning value for each transmission gear in the nonvolatile memory and utilizes the reference learning value for each transmission gear stored in the nonvolatile memory for detecting the coupling state of the clutch, when the vehicle travels next time.

(5) The internal combustion engine control apparatus is characterized in that in the case where the transmission gear is in the position "0", the clutch state detection unit determines that the internal combustion engine and the driving device are not coupled with each other; in the case where the transmission gear is not in the position "0" and the opening degree of the throttle is the same as or larger than a predetermined value, the clutch state detection unit determines that the internal combustion engine and the driving device are coupled with each other; in the case where the transmission gear is not in the position "0", the opening degree of the throttle is smaller than the predetermined value, and the transmission gear is not in the position "1", the clutch state detection unit determines the state of coupling between the internal combustion engine and the driving device, based on the difference between the reference learning value and a real calculation value indicating the ratio of the vehicle speed to the real rotation speed of the internal combustion engine; and in the case where the transmission gear is not in the position "0", the opening degree of the throttle is smaller than the predetermined value, and the transmission gear is in the position "1", the clutch state detection unit determines the state of coupling between the internal combustion engine and the driving device, based on a predetermined value other than the reference learning value and the real calculation value indicating the ratio of the vehicle speed to the real rotation speed of the internal combustion engine.

Various modifications and alterations of this invention will be apparent to those skilled in the art without departing from the scope and spirit of this invention, and it should be understood that this is not limited to the illustrative embodiments set forth herein.

What is claimed is:

1. An internal combustion engine control apparatus comprising:

a clutch that controls coupling between an internal combustion engine mounted in a vehicle and a driving device of the vehicle;

a clutch lever that operates the clutch;

a vehicle speed sensor that detects a speed of the vehicle;

a gear detection device that detects a transmission gear transmitting an output of the internal combustion engine to the driving device;

a rotation sensor that detects a real rotation speed of the internal combustion engine;

a throttle opening degree sensor that detects an opening degree of a throttle valve for controlling an air-intake amount of the internal combustion engine;

an electronic-control fuel injection device that controls a fuel injection amount and the air-intake amount of the internal combustion engine, based on an operation state of at least one of the vehicle and the internal combustion engine; and a clutch state detection unit that determines a state of coupling, through the clutch, between the internal combustion engine and the driving device, based on information on the real rotation speed of the internal combustion engine detected by the rotation sensor and the speed of the vehicle detected by the vehicle speed sensor;

wherein at least one of the fuel injection amount and the air-intake amount is corrected in accordance with the state of coupling detected by the clutch state detection unit, wherein there is provided a reference value learning function that learns a real calculation value, as a reference learning value for the transmission gear, when there are satisfied a first condition that a vehicle speed detected by the vehicle speed sensor, a real rotation speed detected by the rotation sensor, and a throttle opening degree detected by the throttle opening degree sensor are in predetermined ranges and a second condition that the real calculation value indicating the ratio of the vehicle speed detected by the vehicle speed sensor to the real rotation speed detected by the rotation sensor is in a predetermined state, and wherein the reference value learning function is provided with an upper-limit rotation speed of the internal combustion engine for each throttle opening degree and learns, as the reference learning value for each transmission gear, the real calculation value indicating the ratio of the vehicle speed to the real rotation speed, in the case where there is satisfied a fourth condition that the real rotation speed of the internal combustion engine is the same as or smaller than the upper-limit rotation speed.

2. The internal combustion engine control apparatus according to claim 1, wherein the reference value learning function further includes a monitoring function that monitors every constant time a real calculation value indicating the ratio of the vehicle speed to the real rotation speed, and learns, as the reference learning value for each gear, the real calculation value indicating the ratio of the vehicle speed to the real rotation speed, when there is satisfied a third condition that the throttle opening degree is the same as or larger than a predetermined value and the real calculation value indicating the ratio of the vehicle speed to the real rotation speed does not change for a predetermined time.

3. The internal combustion engine control apparatus according to claim 1, further including a nonvolatile memory, contents stored in which are not deleted even when a power source is off, wherein the reference value learning function stores the reference learning value for each transmission gear in the nonvolatile memory and utilizes the reference learning value for each transmission gear stored in the nonvolatile memory for detecting the coupling state of the clutch, when the vehicle travels next time.

4. The internal combustion engine control apparatus according to claim 1, wherein in the case where the transmission gear is in the position "0", the clutch state detection unit determines that the internal combustion engine and the driving device are not coupled with each other; in the case where the transmission gear is not in the position "0" and the opening degree of the throttle is the same as or larger than a predetermined value, the clutch state detection unit determines that the internal combustion engine and the driving device are coupled with each other; in the case where the transmission gear is not in the position "0", the opening degree of the throttle is smaller than the predetermined value, and the transmission gear is not in the position "1", the clutch state detection unit determines the state of coupling between the internal combustion engine and the driving device, based on the difference between the reference learning value and the real calculation value indicating the ratio of the vehicle speed to the real rotation speed of the internal combustion engine; and in the case where the transmission gear is not in the position "0", the opening degree of the throttle is smaller than the predetermined value, and the transmission gear is in the position "1", the clutch state detection unit determines the state of coupling between the internal combustion engine and the driving device, based on a predetermined value other than the reference learning value and the real calculation value indicating the ratio of the vehicle speed to the real rotation speed of the internal combustion engine.

* * * * *